US006750736B1

(12) United States Patent
Weller et al.

(10) Patent No.: US 6,750,736 B1
(45) Date of Patent: Jun. 15, 2004

(54) SYSTEM AND METHOD FOR PLANAR TRANSMISSION LINE TRANSITION

(75) Inventors: Thomas M. Weller, Lutz, FL (US); Matthew C. Smith, Largo, FL (US); James W. Culver, Seminole, FL (US); Jason N. Naylor, Largo, FL (US)

(73) Assignee: Raytheon Company, Waltham, MA (US)

( * ) Notice: Subject to any disclaimer, the term of this patent is extended or adjusted under 35 U.S.C. 154(b) by 3 days.

(21) Appl. No.: 10/193,982

(22) Filed: Jul. 12, 2002

(51) Int. Cl.[7] ..... H01P 5/107
(52) U.S. Cl. ..... 333/26; 333/33
(58) Field of Search ..... 333/26, 33, 100, 333/136, 113, 117, 122, 157, 161

(56) References Cited

U.S. PATENT DOCUMENTS 4,127,831 A * 11/1978 Riblet ..... 333/113
5,056,122 A * 10/1991 Price ..... 375/324
5,202,651 A * 4/1993 Yoshimasu ..... 333/170
5,467,063 A * 11/1995 Burns et al. ..... 333/125

OTHER PUBLICATIONS

Jerald A. Weiss, "*Dispersion and Field Analysis of Microstrip Meander Line Slow–Wave Structure*", IEEE Trans. MTT, vol. 12; (pp. 1194–1201).

Ralph Spickermann and Nadir Dagli, "*Experimental Analysis of Millimeter Wae Coplanar Waveguide Slow Wave Structures on GaAs*", IEEE Trans. MTT, vol. 42, No. 10; (pp. 1918–1924).

H. Hasegawa and H. Okizaki, "*MIS and Schottky slow–wave coplanar stripline on GaAs substrates*"*Electronics Letters* , vol. 13, (pp. 663–664).

R. Spickermann and N. Dagli, "*Millimetere Wave Coplanar Slow Wave Structure On GaAs Suitable For Use In Electro–Optic Modulators*", Electronics Letters, vol. 32, No. 15; (pp. 1377–1378).

A. Gorur, et al., "*Modified Coplanar Meander Transmission Line for MMICs*", Electronics Letters, vol. 30 (pp. 1317–1318).

J. Naylor, T. Weller, J. Culver and M. Smith, "*Miniaturized Slow–Wave Coplanar Waveguide Circuits on High–Resistivity Silicon*", Department of Electrical Engineering, University of South Florida; (pp. 1–4).

J. Sor, et al., "*A Novel Low–Loss Slow–Wave CPW Periodic Structure for Filter Applications*", 2001 IEEE MTT–S Digest (pp. 307–310).

Kuang–Ping Ma, Yongxi Qian and Tatsuo Itoh, "*Analysis and Applications of a New CPW–Slotline Transition*", IEEE Trans. MTT, vol. 47, No. 4; (pp. 426–432).

* cited by examiner

*Primary Examiner*—Don Le
(74) *Attorney, Agent, or Firm*—Baker Botts L.L.P.

(57) ABSTRACT

According to one embodiment of the invention, a planar transmission line transition system includes a coplanar waveguide transmission line that includes a first electrical path and a second electrical path. The planar transmission line transition system also includes a transmission line stub electrically connected in series to the first electrical path of the coplanar waveguide transmission line, wherein a signal output at a first connection of the transmission line stub is phase delayed approximately 180 degrees with respect to a signal input at a second connection of the transmission line stub. The planar transmission line transition system further includes a transmission line electrically connected to the second electrical path of the coplanar waveguide transmission line and the first connection of the transmission line stub.

20 Claims, 3 Drawing Sheets

SYSTEM AND METHOD FOR PLANAR TRANSMISSION LINE TRANSITION

TECHNICAL FIELD OF THE INVENTION

This invention relates generally to transmission lines that carry electronic signals and more particularly to a system and method for planar transmission line transition.

BACKGROUND OF THE INVENTION

Electrical signals such as microwave or millimeter-wave signals may be communicated across an electrical circuit using various types of planar transmission line structures. When more than one type of planar transmission line is used, transitions between the various structures are necessary. Conventional transition structures are susceptible to signal losses from both signal reflection and signal transmission. Conventional transmission structures also occupy significant amounts of scarce surface area in integrated circuit designs, which in turn limits efforts to miniaturize circuits.

SUMMARY OF THE INVENTION

According to one embodiment of the invention, a planar transmission line transition system includes a coplanar waveguide transmission line that includes a first electrical path and a second electrical path. The planar transmission line transition system also includes a transmission line stub electrically connected in series to the first electrical path of the coplanar waveguide transmission line, wherein a signal output at a first connection of the transmission line stub is phase delayed approximately 180 degrees with respect to a signal input at a second connection of the transmission line stub. The planar transmission line transition system further includes a transmission line electrically connected to the second electrical path of the coplanar waveguide transmission line and the first connection of the transmission line stub.

Some embodiments of the invention provide numerous technical advantages. Other embodiments may realize some, none, or all of these advantages. For example, according to one embodiment, the size of the transmission line stub is reduced by employing a slow-wave structure. Reducing the size of the transmission line stub significantly reduces the surface area required for the planar transmission line transition system, and may be useful in microwave or millimeter-wave electronics systems where miniaturization is desirable. In some embodiments, the planar transmission line transition system minimizes signal loss due to reflection or transmission.

Other advantages may be readily ascertainable by those skilled in the art from the following FIGURES, description, and claims.

BRIEF DESCRIPTION OF THE DRAWINGS

For a more complete understanding of the present invention and the advantages thereof, reference is now made to the following description taken in conjunction with the accompanying drawings, wherein like reference numbers represent like parts, and which.

DETAILED DESCRIPTION OF EXAMPLE EMBODIMENTS OF THE INVENTION

Embodiments of the invention are best understood by referring to FIGS. 1 through 5 of the drawings, like numerals being used for like and corresponding parts of the various drawings.

Figure 1:
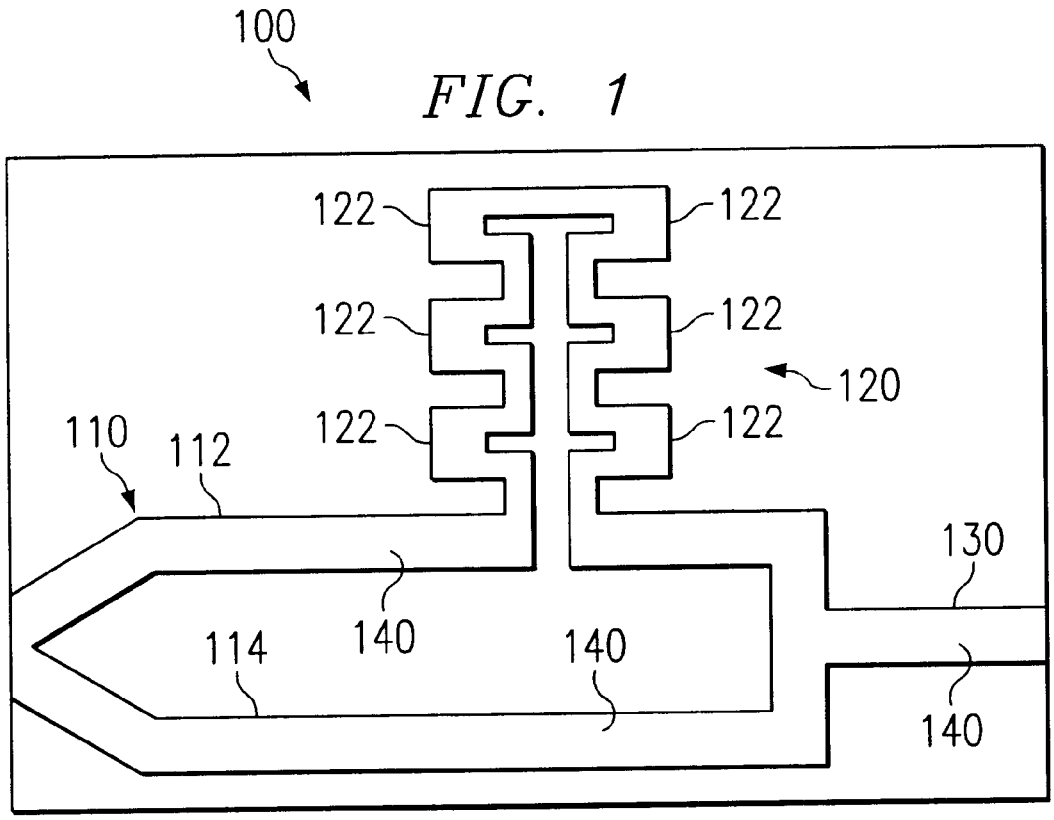
FIG. 1 illustrates a planar transmission line transition system in one embodiment of the present invention.

FIG. 1 illustrates a planar transmission line transition system 100 in one embodiment of the present invention. Planar transmission line transition system 100 includes a coplanar waveguide transmission line (CPW) 110, a slot-line transmission line 130, and a transmission line stub 120.

CPW 110, slot-line transmission line 130, and transmission line stub 120 may be formed by placing metal layers on a substrate 140. In one embodiment of the present invention, CPW 110, slot-line transmission line 130, and transmission line stub 120 are formed from chromium-silver-chromium-gold (Cr—Ag—Cr—Au) metal layers approximately one micron ($\mu$m) thick; however, CPW 110, slot-line transmission line 130, and transmission line stub 120 formed from any suitable material are within the scope of the present invention. CPW 110, slot-line transmission line 130, and transmission line stub 120 are formed by placing the metal layers on a substrate 140, which in one embodiment is silicon. In one embodiment of the present invention, substrate 140 is made of highly-resistive silicon.

CPW 110 is operable to carry an electrical signal and includes a first electrical path 112 and a second electrical path 114. In operation the electrical field of the signal in electrical path 112 is 180 degrees out of phase with the electrical field of the signal in electrical path 114. For purposes of illustration planar transmission line transition system 100 will be described in terms of an electrical signal moving from CPW 110 to slot-line transmission line 130 by way of transmission line stub 120; however, an electrical signal may also move from slot-line transmission line 130 to CPW 110 by way of transmission line stub 120 within the scope of the present invention. In one embodiment, the electrical signal is in microwave or millimeter-wave format.

Transmission line stub 120 is connected in series to electrical path 112 of CPW 110. In one embodiment the configuration and path length of transmission line stub 120 are selected so that a signal output by transmission line stub 120 is phase delayed approximately 180 degrees with respect to a signal input into transmission line stub 120. Transmission line stub 120 is operable to transition an electrical signal between CPW 110 and slot-line transmission line 130. In one embodiment transmission line stub 120 is a slow-wave transmission line stub, comprised of a plurality of path lengths 122 arranged in a comb-like design. A slow-wave structure is one that reduces the propagation velocity of an electromagnetic signal relative to other signal transmission paths in the vicinity of the slow-wave structure.

One end of slot-line transmission line 130 is electrically connected with electrical path 114 of CPW 110 and transmission line stub 120. Slot-line transmission line 130 is operable to carry an electrical signal along a single slot-line path.

Thus, in one embodiment of the present invention, planar transmission line transition system 100 is operable to transition signals between CPW 110 and slot-line transmission line 130. Planar transmission line transition system 100 provides a 180 degree phase delay to a signal component using a design that occupies less surface space than a conventional signal transition system. Planar transmission line transition system 100 also experiences less signal attenuation from signal transmission and reflection than does a conventional signal transition system.

Figure 2:
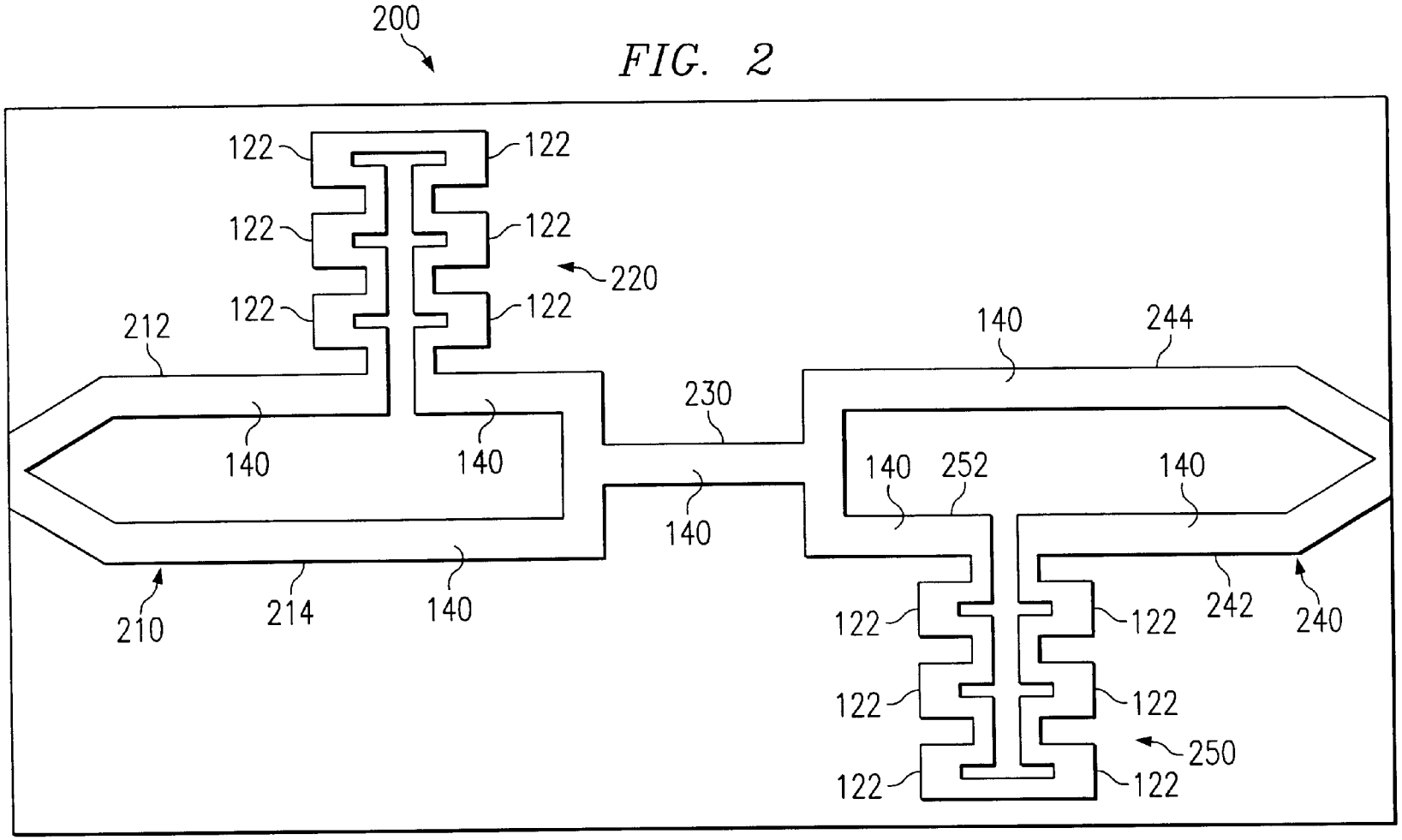
FIG. 2 illustrates a back-to-back configuration of the planar transmission line transition system in another embodiment of the present invention.

Referring now to FIG. 2 there is illustrated a back-to-back configuration of a planar transmission line transition system 200 in another embodiment of the present invention. Planar transmission line transition system 200 includes a first CPW 210, a first transmission line stub 220, a slot-line transmission line 230, a second transmission line stub 250, and a second CPW 240.

Within planar transmission line transition system 200 CPW 210 is operable to carry an electrical signal along a first electrical path 212 and a second electrical path 214. In operation the electrical field of the signal in electrical path 212 is 180 degrees out of phase with the electrical field of the electrical field of the signal in electrical path 214.

Transmission line stub 220 is connected in series to electrical path 212 of CPW 210. In one embodiment the configuration and path of transmission line stub 220 are selected so that a signal output by transmission line stub 220 is phase delayed approximately 180 degrees with respect to a signal input into transmission line stub 220. Transmission line stub 220 is operable to transition an electrical signal between CPW 210 and slot-line transmission line 230. In one embodiment, transmission line stub is a slow-wave transmission line stub.

In a similar manner CPW 240 is operable to carry an electrical signal and includes a first electrical path 242 and a second electrical path 244. Transmission line stub 250 is operable to transition an electrical signal between CPW 240 and slot-line transmission line 230. In one embodiment, transmission line stub 250 is a slow-wave transmission line stub.

Within planar transmission line transition system 200, therefore, an electrical signal carried by CPW 210 may be transitioned to slot-line transmission line 230, and the signal can be transitioned again from slot-line transmission line 230 to CPW 240. An electrical signal may also be carried from CPW 240 to CPW 210 by way of slot-line transition line 230.

The operation of planar transmission line transition system 200 will now be considered in greater detail. An electrical signal may be carried by CPW 210 across electrical paths 212 and 214. In operation, the electrical field of the signal in electrical path 212 is 180 degrees out of phase with the electrical field of the signal in electrical path 214. Transmission line stub 220 adds length to the path that a signal in electrical path 212 must travel to reach slot-line transmission line 230. In one embodiment the configuration and path length of transmission line stub 220 are selected so that a signal output by transmission line stub 220 is phase delayed approximately 180 degrees with respect to a signal input into transmission line stub 220. In this way the electrical signal on electrical path 214 and the signal output from transmission line stub 220 will be in phase. Thus, with the two signals from CPW 210 in phase, the signals are combined and carried by slot-line transmission line 230.

When the signal carried by slot-line transmission line 230 reaches CPW 240, the signal will be carried further by the two paths 244 and 252. The electrical field of the signal in electrical path 244 will be in phase with the electrical field of the signal in electrical path 252. When the signal in electrical path 252 passes through transmission line stub 250 and is output at electrical path 242, however, the electric field of the signal will be 180 degrees out of phase with the electrical field of the signal in electrical path 244. In one embodiment, the phase delay occurs because the configuration and path length of transmission line stub 250 are selected so that a signal output by transmission line stub 250 is phase delayed approximately 180 degrees with respect to a signal input into transmission line stub 250.

Figure 3:
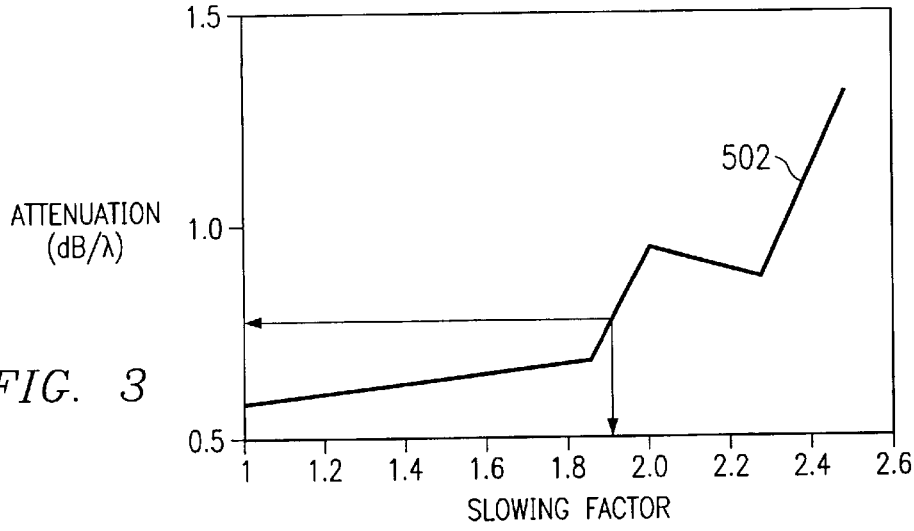
FIG. 3 illustrates a graph of slowing factors versus attenuation in a slow-wave transmission line stub in one embodiment of the present invention.

In one embodiment of the present invention, transmission line stubs 220 and 250 of signal transition system 200 are slow-wave transmission line stubs. Referring now to FIG. 3, there is graphically illustrated a graph of attenuation (in decibels (dB) per wavelength (λ)) for a plurality of slowing factors in a slow-wave transmission line in one embodiment of the present invention. The values of FIG. 3 were determined using a slow-wave transmission line design with a characteristic impedance of approximately 50 Ω at a frequency of 20 GHz. Curve 502 illustrates that for a slow-wave transmission line, the attenuation/λ increases marginally while providing a slowing factor of two or more as compared with a conventional transmission line geometry. Slowing factor refers to a factor of reduction in signal phase velocity greater than that achieved using a conventional transmission line geometry. For example a slow-wave transmission line may have a slowing factor of approximately 1.85, meaning the slow-wave transmission line reduces signal phase velocity 1.85 times more than a conventional transmission line geometry. The slow-wave transmission line with a slowing factor of 1.85 does increase signal attenuation from approximately 0.60 to approximately 0.75 dB/λ, but this amount of attenuation does not offset the advantages gained by the slowing factor. FIG. 3 illustrates that the slow-wave transmission line wavelength may be reduced up to 2.5 times with relatively small increases in attenuation.

The size of the transmission line stub in one embodiment of the present invention is significantly reduced by employing a slow-wave transmission line stub structure. The slow-wave structure effectively doubles the phase shift per unit length in comparison to a conventional transmission line stub geometry. In one embodiment a slow-wave transmission line stub may be as much as 50% smaller than a conventional signal transition structure. By implementing slow-wave transmission line stubs in planar transmission line transition systems 100 and 200, the amount of circuit surface area required to implement the system may be reduced. Miniaturized planar transmission line transition systems 100 and 200 may be utilized in numerous applications in distributed circuit designs.

Figure 4:
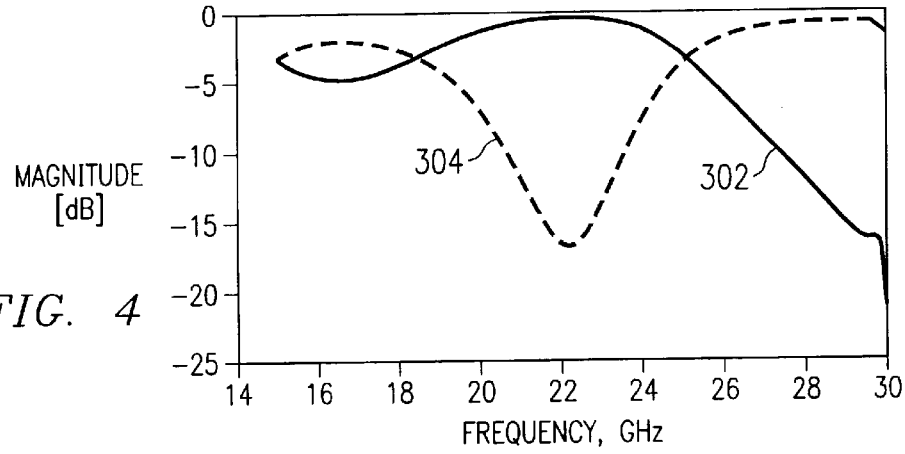
FIG. 4 graphically illustrates a simulated signal transmission and signal reflection response for the planar transmission line transition system of FIG. 2.

Referring now to FIG. 4 there is graphically illustrated a full wave simulation result for a signal communicated through planar transmission line transition system 200. Curve 302 illustrates a signal transmission through planar transmission line transition system 200, and curve 304 illustrates a signal reflection within planar transmission line transition system 200. FIG. 3 illustrates that in one embodiment planar transmission line transition system 200 is well-suited to transition signals at approximately 22 GHz. A high signal transmission level is achieved at approximately 22 GHz, with a corresponding low signal reflection level at that same frequency. Other embodiments of the present invention are envisioned that transmit a different signal frequency with little reflection at that frequency.

Figure 5:
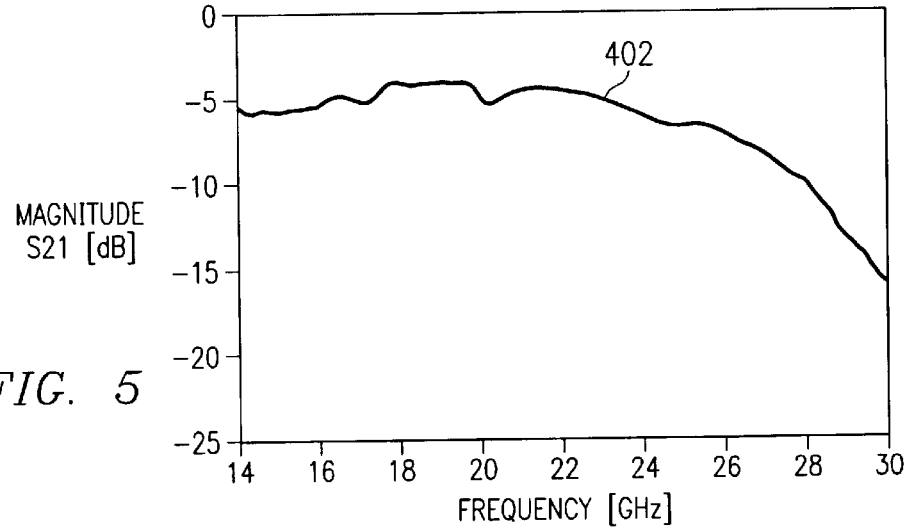
FIG. 5 graphically illustrates a measured signal transmission response for the planar transmission line transition system of FIG. 2.

Referring now to FIG. 5 there is graphically illustrated a full wave signal transmission for the signal transition system

200 of FIG. 2 as actually measured. Curve 402 does not exactly follow the simulated curve 302 of FIG. 4. In one embodiment the signal transmission level at a frequency of approximately 22 GHz is not as high as predicted by FIG. 4.

Although the present invention has been described with several example embodiments, various changes and modifications may be suggested to one skilled in the art. It is intended that the present invention encompass those changes and modifications as they fall within the scope of the claims.

What is claimed is:

1. A planar transmission line transition system, comprising:

a coplanar waveguide transmission line comprising a first electrical path and a second electrical path;

a transmission line stub electrically connected in series to the first electrical path of the coplanar waveguide transmission line, wherein a signal output at a first connection of the transmission line stub is phase delayed approximately 180 degrees with respect to a signal input at a second connection of the transmission line stub;

a transmission line electrically connected to the second electrical path of the coplanar waveguide transmission line and the first connection of the transmission line stub.

2. The system of claim 1, wherein the transmission line stub comprises a slow-wave transmission line stub.

3. The system of claim 1, wherein the signal comprises a microwave signal.

4. The system of claim 1, wherein the signal comprises a millimeter-wave signal.

5. The system of claim 1, wherein the transmission line is a slot-line transmission line.

6. The system of claim 1, further comprising a substrate.

7. The system of claim 6, wherein the coplanar waveguide transmission line, transmission line stub, and transmission line are comprised of a plurality of metal layers located on the substrate.

8. A planar transmission line transition system, comprising:

a first coplanar waveguide transmission line comprising a first electrical path and a second electrical path;

a slot-line transmission line;

a second coplanar waveguide transmission line comprising a first electrical path and a second electrical path;

a first transmission line stub electrically connected in series to the first electrical path of the first coplanar waveguide transmission line, wherein a signal output at a first connection of the first transmission line stub is phase delayed approximately 180 degrees with respect to a signal input at a second connection of the first transmission line stub; and a second transmission line stub electrically connected in series to the first electrical path of the second coplanar waveguide transmission line, wherein a signal output at a first connection of the second transmission line stub is phase delayed approximately 180 degrees with respect to a signal input at a second connection of the second transmission line stub.

9. The system of claim 8, wherein the first and second transmission line stubs comprise slow-wave transmission line stubs.

10. The system of claim 8, wherein the signal comprises a microwave signal.

11. The system of claim 8, wherein the signal comprises a millimeter-wave signal.

12. The system of claim 8, further comprising a substrate.

13. The system of claim 8, wherein the first and second coplanar waveguide transmission lines, slot-line transmission line, and first and second transmission line stubs are comprised of a plurality of metal layers located on the substrate.

14. A method of planar transmission line transitioning, comprising:

providing a coplanar waveguide transmission line comprising a first electrical path and a second electrical path;

providing a transmission line stub electrically connected in series to the first electrical path of the coplanar waveguide transmission line;

phase delaying a signal output at a first connection of the transmission line stub approximately 180 degrees with respect to a signal input at a second connection of the transmission line stub; and electrically connecting the second electrical path of the coplanar waveguide transmission line and the first connection of the transmission line stub.

15. The method of claim 14, further comprising electrically connecting the second electrical path of the coplanar waveguide transmission line and the first connection of the transmission line stub with a slot-line transmission line.

16. The method of claim 14, wherein the transmission line stub comprises a slow-wave transmission line stub.

17. The method of claim 14, wherein the signal is a microwave signal.

18. The method of claim 14, wherein the signal is a millimeter-wave signal.

19. The method of claim 14, further comprising providing a substrate.

20. The method of claim 19, wherein the coplanar waveguide transmission line and transmission line stub are comprised of a plurality of metal layers located on the substrate.

* * * * *